US010743689B2

(12) United States Patent
Shahian

(10) Patent No.: US 10,743,689 B2
(45) Date of Patent: Aug. 18, 2020

(54) SYSTEMS AND METHODS RELATING TO NOVEL TWO-CHAMBERED DRINKING RECEPTACLES

(71) Applicant: Ramtin Shahian, Los Angeles, CA (US)

(72) Inventor: Ramtin Shahian, Los Angeles, CA (US)

(73) Assignee: Ramtin Shahian, Los Angeles, CA (US)

( * ) Notice: Subject to any disclaimer, the term of this patent is extended or adjusted under 35 U.S.C. 154(b) by 0 days.

(21) Appl. No.: 16/726,280

(22) Filed: Dec. 24, 2019

(65) Prior Publication Data

US 2020/0196784 A1 Jun. 25, 2020

Related U.S. Application Data

(60) Provisional application No. 62/784,561, filed on Dec. 24, 2018.

(51) Int. Cl.
*B65D 1/04* (2006.01)
*A47G 19/22* (2006.01)
*A47G 19/12* (2006.01)

(52) U.S. Cl.
CPC .... *A47G 19/2255* (2013.01); *A47G 2019/122* (2013.01)

(58) Field of Classification Search
CPC ..... B65D 81/3211; B65D 81/3238; B65D 51/2807; B65D 51/2857; B65D 51/2864; A47G 19/2255; A47G 2019/122
USPC ..... 206/219, 221; 215/10
See application file for complete search history.

(56) References Cited

U.S. PATENT DOCUMENTS

2006/0049127 A1* 3/2006 Katz ..... B65D 81/3211 215/6
2008/0035646 A1* 2/2008 Smith ..... B65D 21/083 220/526

* cited by examiner

*Primary Examiner* — King M Chu
(74) *Attorney, Agent, or Firm* — EcoTech Law Group, P.C.

(57) ABSTRACT

Drinking receptacles and methods related thereto are described. The drinking receptacles include: a first component comprising a first fluid chamber and a hub assembly engaged thereto; and a second component comprising a fluid-flow regulator attached to a cylindrical body, with a second fluid chamber defined therein, such that pins on an outer surface of the first fluid chamber of the first component slidably engage with channels on an inner surface of the fluid-flow regulator of the second component to form a drinking receptacle, and the drinking receptacle may be transformed, by slidably displacing the first component relative to the second component, between a closed configuration, where a flow path is blocked between the first fluid chamber and the second fluid chamber, and an open configuration, where a flow path is open between the first fluid chamber and the second fluid chamber.

20 Claims, 13 Drawing Sheets

SYSTEMS AND METHODS RELATING TO NOVEL TWO-CHAMBERED DRINKING RECEPTACLES

RELATED CASE

This application claims priority to U.S. provisional application No. 62/784,561, filed Dec. 24, 2018, and is incorporated herein by reference for all purposes.

FIELD

The present arrangements and teachings relate generally to portable and re-usable drinking receptacles. More particularly, the present arrangements and teachings relate to two-chambered portable and re-usable drinking receptacles where, in a closed configuration of the drinking receptacles, a flow path between a bottom chamber and a top chamber is closed, and in an open configuration of the drinking receptacle, a flow path between a bottom chamber and a top chamber is open, and methods of using and assembling relating thereto.

BACKGROUND

Use of portable, re-washable, and/or non-disposable drinking receptacles, such as ceramic, glass, plastic (e.g., certain durable plastics susceptible to repeated use), or stainless-steel tumblers, cups, bottles, and the like, is ubiquitous. Certain of these drinking receptacles provide advantages over conventional disposable cups (e.g., paper, Styrofoam, and plastic cups), because they produce less waste, are sturdier, require fewer resources from the environment (as they are reusable over time), are generally less expensive over time (i.e., susceptible to repeated use), and preserve the temperature of the beverages being consumed therefrom.

Unfortunately, such non-disposable drinking receptacles suffer from certain drawbacks. While such non-disposable drinking receptacle are portable, they nevertheless must generally be re-washed after a single use, thus limiting their practical use, as they must then be carried until the user reaches home or another location with washing equipment, such as a faucet and sink with soap. Thus, the user may not be able to wash the receptacle for an extended period of time after use. During this time, residue (e.g., from coffee or tea remaining in the drinking receptacle, or from other components, such as granulated sugar, tea leaves, or coffee grounds, remaining) may have solidified or collected in the drinking receptacle, leaving it smelly, prone to making a mess if leaking, and more difficult to wash at a later time if components dry and/or stick to the receptacle. It can be very unpleasant carrying around such a dirty drinking receptacle for extended periods of time until they may be washed, and delay in washing may make the drinking receptacle more difficult to wash by the time appropriate washing equipment and materials are available. Further, a user of such non-disposable drinking receptacles may not be able to use the drinking receptacle again until that user has access to appropriate washing equipment and materials. What is therefore needed are portable, re-washable drinking receptacles that do not suffer from these and other drawbacks associated with more conventional designs for portable and/or reusable drinking receptacles.

SUMMARY OF THE INVENTION

To achieve the foregoing, in one aspect, the present arrangements disclose a drinking receptacle. The drinking receptacle includes: (i) a first component that includes: (a) a first fluid chamber (e.g., a bottom fluid chamber) to hold a first fluid (e.g., a cleaning solution) and has defined therein, at one end, one or more fluid apertures that allow flow of first fluid in and/or out of the first fluid chamber; (b) one or more pins disposed around an external surface of the first fluid chamber; (ii) a second component including: (a) a second fluid chamber (i.e., a top fluid chamber) for holding second fluid (e.g., a drinking beverage). The second fluid chamber has defined therein a first opening disposed at one end, and has defined therein a second opening disposed at an opposite end, such that the first opening allows receiving and/or dispensing fluid content inside the second fluid chamber and the second opening of the second fluid chamber allows receiving the fluid inside the second fluid chamber; and (b) a fluid-flow regulator designed to allow or restrict flow of the fluid into the second fluid chamber, and which includes a regulating sidewall and a barrier, such that the regulating sidewall has defined thereon one or more channels, each of which contains an open-configuration end and a closed-configuration end, and wherein the barrier has defined thereon the second opening, which defines a flow path between the first fluid chamber and the second fluid chamber. When each of the pins disposed around the first fluid chamber slidably engages with each of the channels of the fluid flow regulator such that each of the pins is disposed at the closed-configuration end of each channel to form a closed configuration of the second opening, flow of both first fluid and second fluid through the flow path is closed. Similarly, when each of the pins is disposed at the open-configuration end of each of the channels to form an open configuration of the second opening, flow of first fluid and second fluid through the flow path is open.

Preferably, the drinking receptacle further includes a hub that is connected to the first component and includes a blocking portion and one or more hub apertures. When the drinking receptacle is in a closed configuration, the hub apertures are not communicatively coupled to the second opening, and the blocking portion aligns and contacts with the second opening to close or block the flow path. Likewise, when the drinking receptacle is in an open configuration, the hub apertures are communicatively coupled to the second opening and the blocking portion does not close, or block, the flow path. According to such embodiments, i.e., the open configuration of the second opening, the hub apertures and the second opening define the flow path, and the blocking portion does not completely block fluid flow through the second opening.

According to preferred embodiments of the present arrangements, the blocking portion includes a sealing member that is part of, or surrounds, the blocking portion and operates to seal off the second opening in the closed configuration of the second opening, i.e., when the drinking receptacle is in a closed configuration.

The drinking receptacle may also include a lid that seals fluid flow out of the first opening of the second (i.e., the top) fluid chamber.

According to preferred embodiments of the present arrangements, the barrier concaves to drain out, under force of gravity, fluid through the second opening of the second fluid chamber, preferably into the first fluid chamber.

Each of the pins on the drinking receptacle may be disengaged from each of the channels, to form a detached, or separated, configuration of the second opening.

According to preferred embodiments of the present arrangements, each of the channels, at the open configuration end, includes a location of entrance and at the closed-configuration end includes a location of ceasing forward displacement, such that the pins initially engage with each of the channels at the location of entrance, and the pins cease forward displacement along each of the channels at the location of ceasing forward displacement. The location of ceasing forward displacement may further include a boundary of the channel and a bridge feature. In a closed configuration, the pins are stabilized between the boundary and the bridge feature.

The channels of the drinking receptacle may also include a plurality of partially open-configuration positions disposed between the open-configuration end and the closed-configuration end, such that one of the partially open-configuration positions ends serves as a rinsing position. The rinsing position is defined by two rinse-bridge features disposed adjacent to each other and of appropriate dimensions such that each of the pins, during a rinsing operation of the drinking receptacle, is stabilized between the two rinse-bridge features.

In an alternate embodiments of the present arrangements, the first component includes a hub having one or more hub apertures, such that in a closed configuration of the second opening, the hub apertures are blocked such that said the hub apertures are not communicatively coupled to the second opening.

In another aspect, the present arrangements and teachings disclose a method of assembling a drinking receptacle. The method includes: (i) obtaining a base component and a hub, such that the base component includes a first fluid chamber that is designed to hold a first fluid, and one or more pins disposed around an external surface of the first fluid chamber, and the hub includes a blocking portion and one or more hub apertures; (ii) coupling the base component with the hub to form a first component; (iii) obtaining a cylindrical component, or sleeve, having a first open end and a second open end, wherein the second open end includes an inner surface; (iv) obtaining a fluid-flow regulator that includes a regulating sidewall and a barrier, wherein the regulating sidewall has defined thereon one or more channels, each of which contains an open-configuration end and a closed-configuration end, and wherein the barrier has a fluid flow opening; (v) inserting the fluid-flow regulator into, and securing the fluid-flow regulator inside, the second open end of the cylindrical component, to form a second component, such that an outer surface of the regulating sidewall of the fluid-flow regulator aligns with and contacts the inner surface of the cylindrical component; and (vi) engaging the first component and the second component to form the drinking receptacle, in which the pins disposed around the first fluid chamber are in position to slidably engage with each of the channels of the fluid flow regulator. Preferably, the first fluid chamber has an opening, and coupling the base component with the hub includes fitting the hub inside the opening of the first fluid chamber.

Figure 3A:
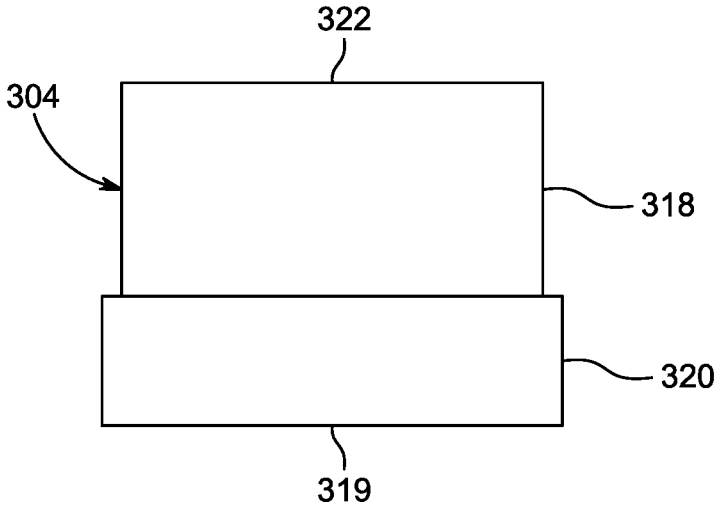
FIG. 3A is a side view of a fluid-flow regulator, according to one embodiment of the present arrangements, that is used in the drinking receptacle assembly of FIG. 1.

Figure is 3B is a side view showing certain internal components, according to one embodiment of the present arrangements, of the fluid-flow regulator of FIG. 3A.

Figure 3B:
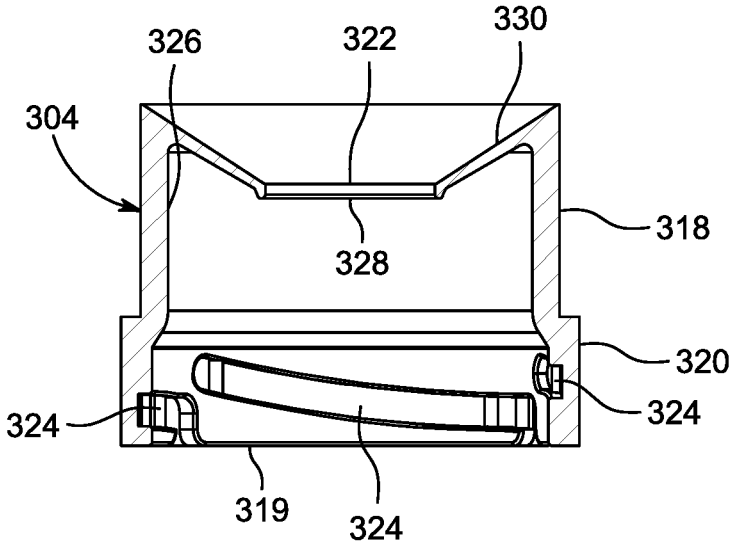
Figure 3C:
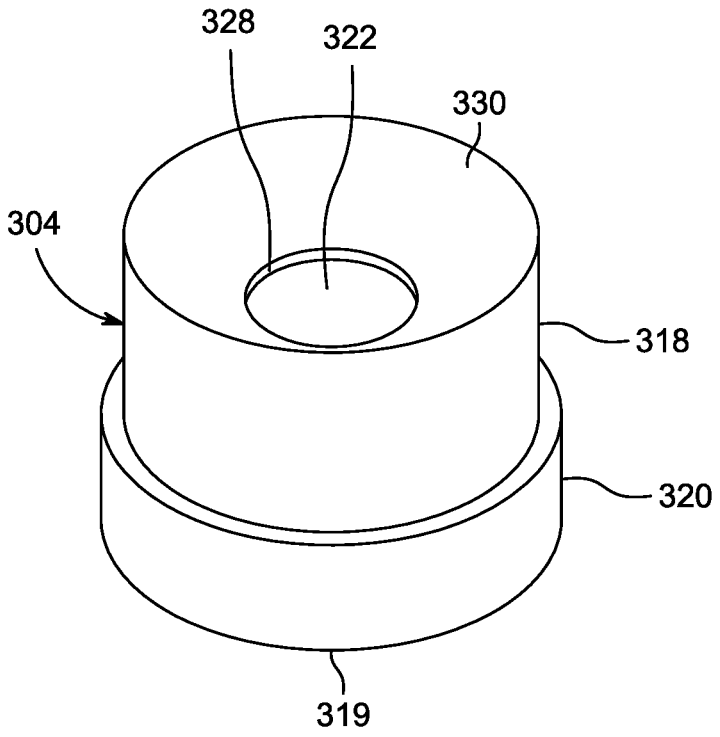

FIG. 3C is a perspective view of the fluid-flow regulator of FIG. 3A.

Figure 4:
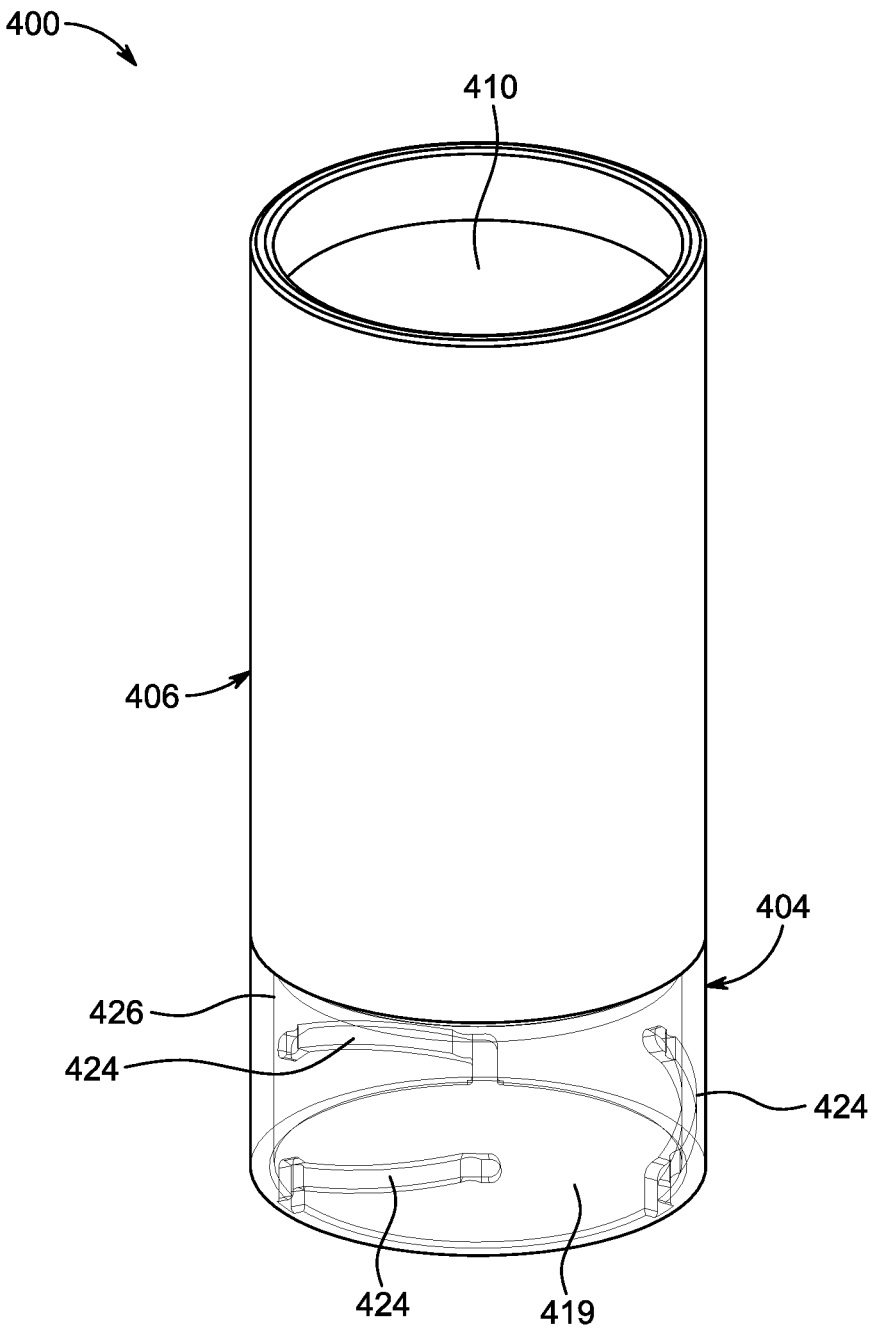

FIG. 4 is a perspective view of a component, according to one embodiment of the present arrangement, that includes a fluid-flow regulator attached to a bottom end of a cylindrical body and showing certain internal components of the fluid-flow regulator.

Figure 1:
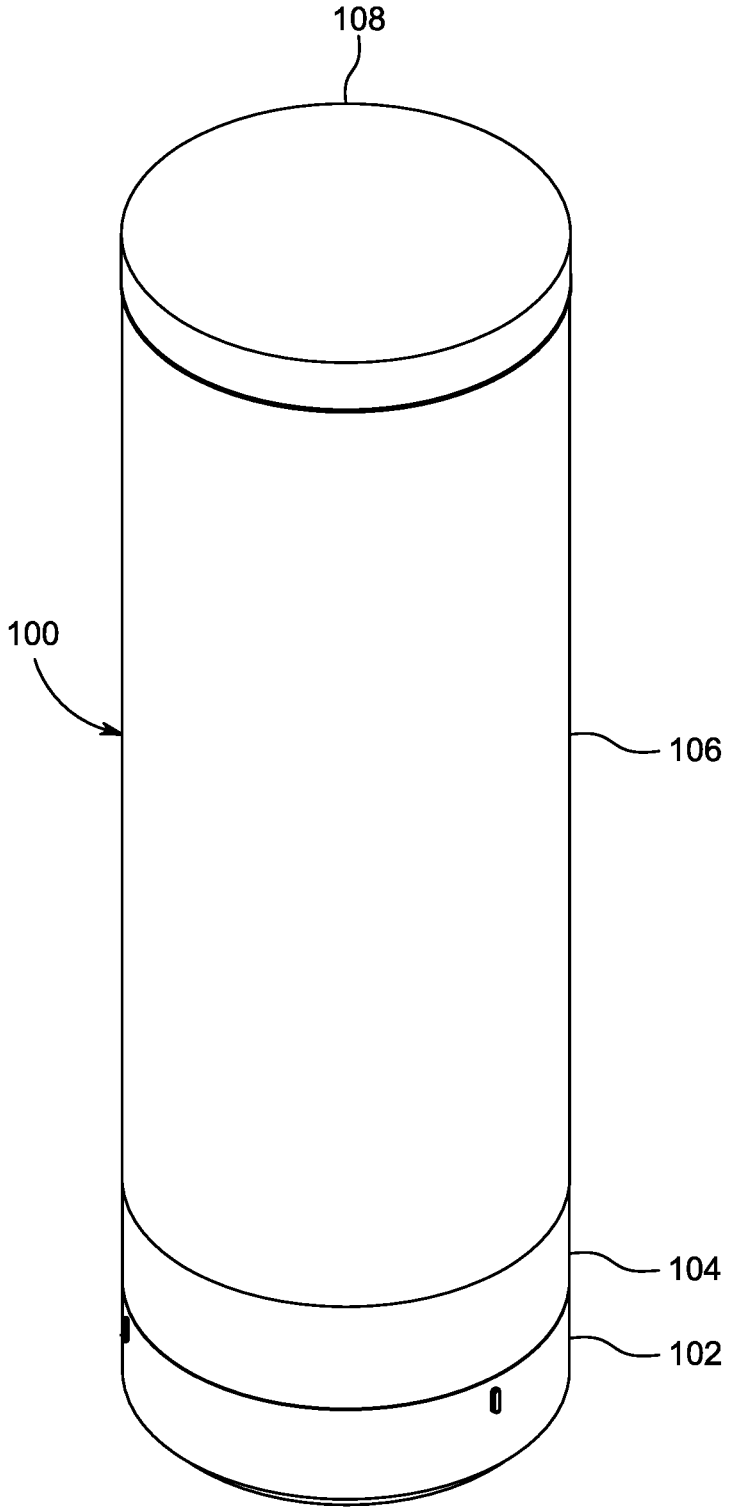
FIG. 1 is a perspective view of a drinking receptacle, according to one embodiment of the present arrangements, in a closed configuration and with a lid secured thereon.
Figure 5A:
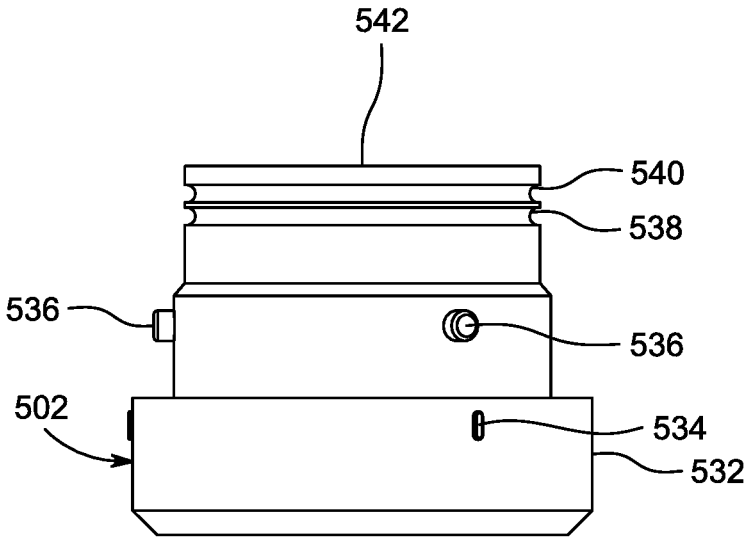

FIG. 5A is a side view of first fluid chamber, according to one embodiment of the present arrangements, that is used in the drinking receptacle assembly of FIG. 1.

Figure 5B:
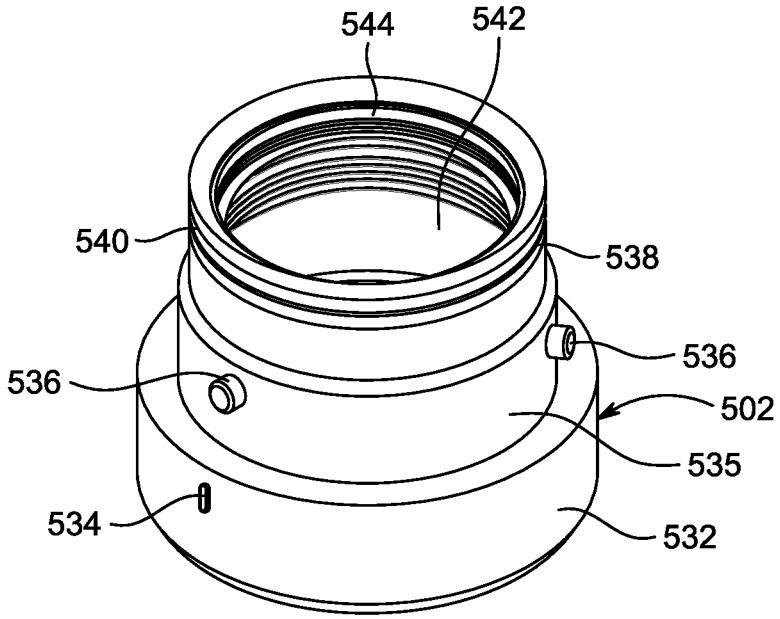

FIG. 5B is a perspective view of the first fluid chamber of FIG. 5A.

Figure 6A:
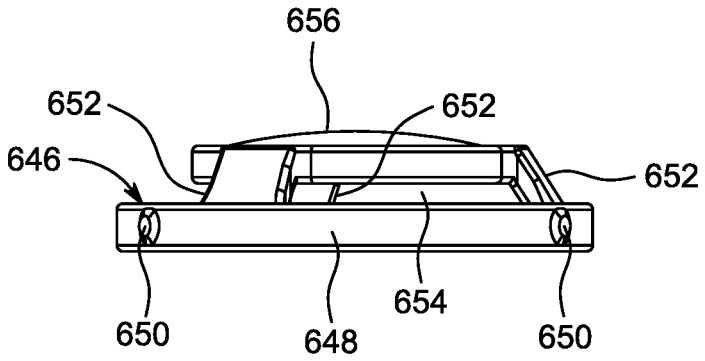

FIG. 6A is a side view of a hub assembly, according to one embodiment of the present arrangements.

Figure 6B:
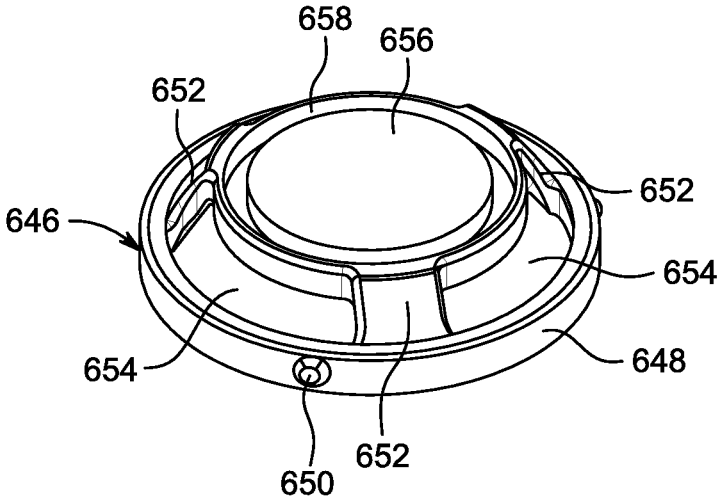

FIG. 6B is a perspective view of the hub assembly of FIG. 6A.

Figure 7:
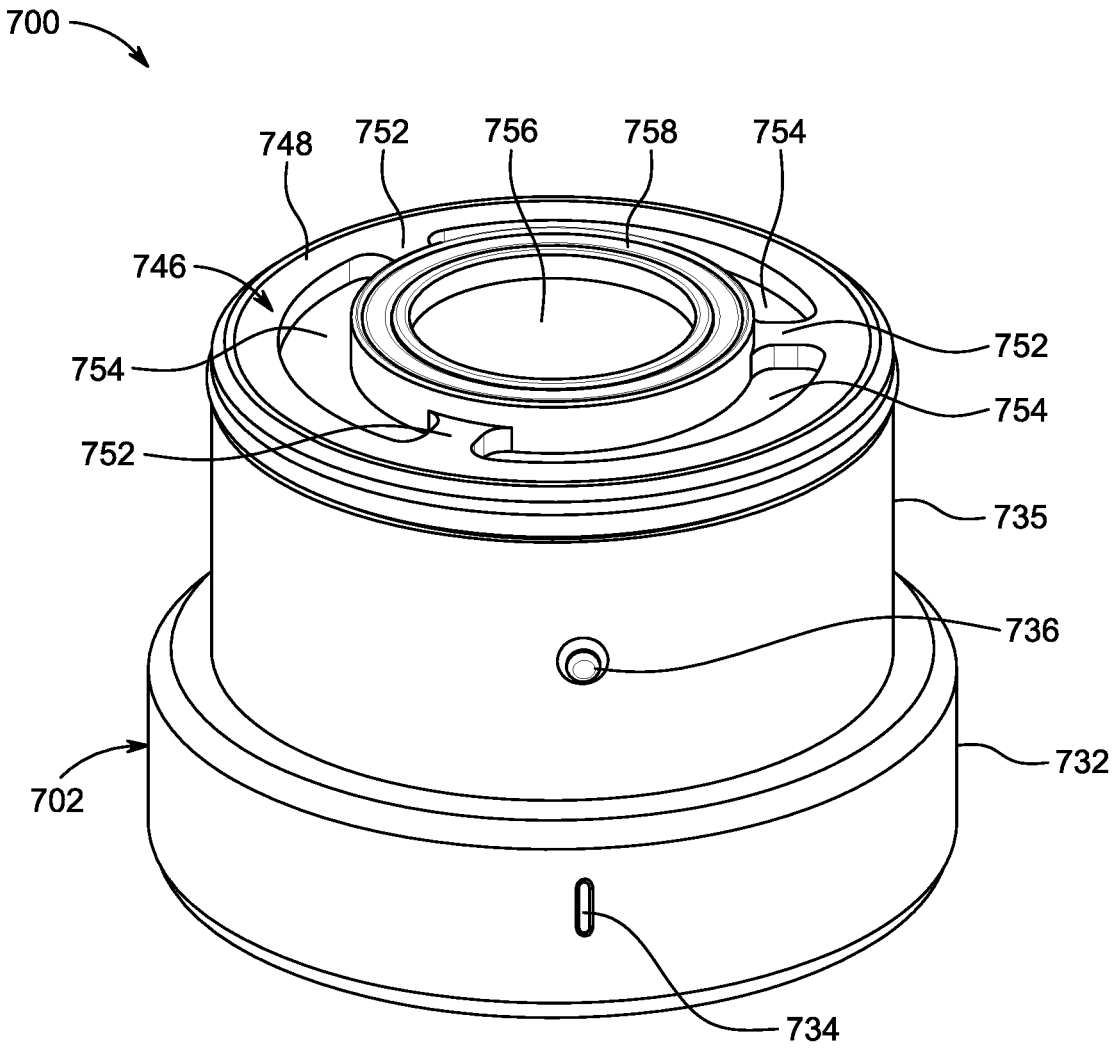

FIG. 7 is a perspective view of a component, according to one embodiment of the present arrangements, that includes a hub assembly coupled to the top end of a first fluid chamber.

Figure 8A:
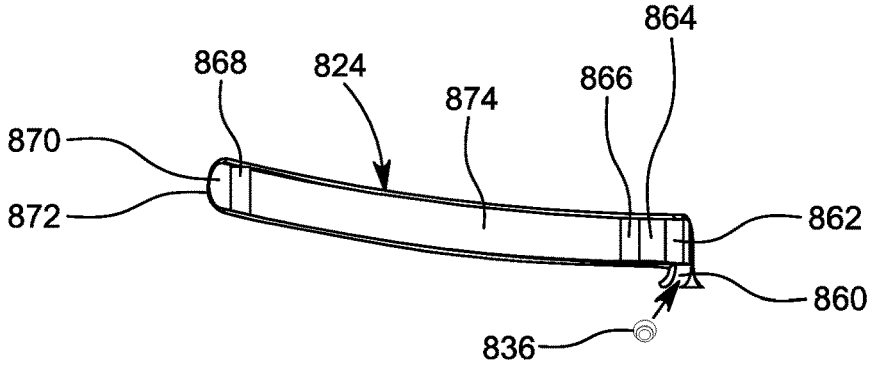

FIG. 8A shows a pin (i.e., used on a first fluid chamber) adjacent to a location of entrance of a channel (i.e., used on a fluid-flow regulator), according to one embodiment of the present arrangements.

Figure 8B:
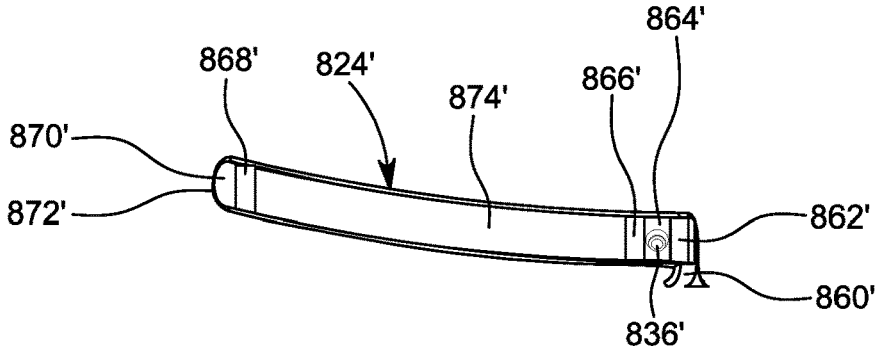

FIG. 8B shows the pin of FIG. 8A secured at location of rinsing along the channel of FIG. 8A.

Figure 8C:
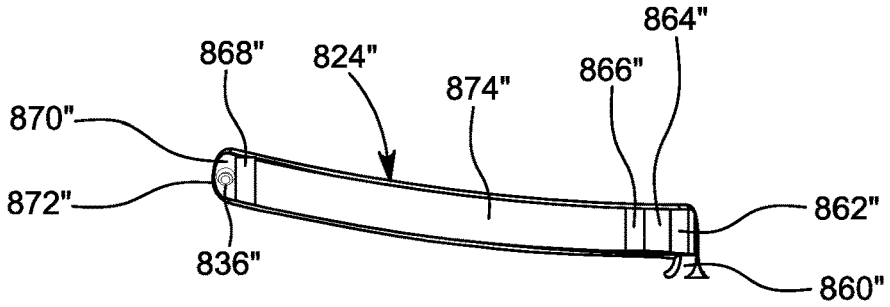

FIG. 8C shows the pin of FIGS. 8A and 8B secured at a location of ceasing forward displacement along the channel of FIGS. 8A and 8B.

Figure 9A:
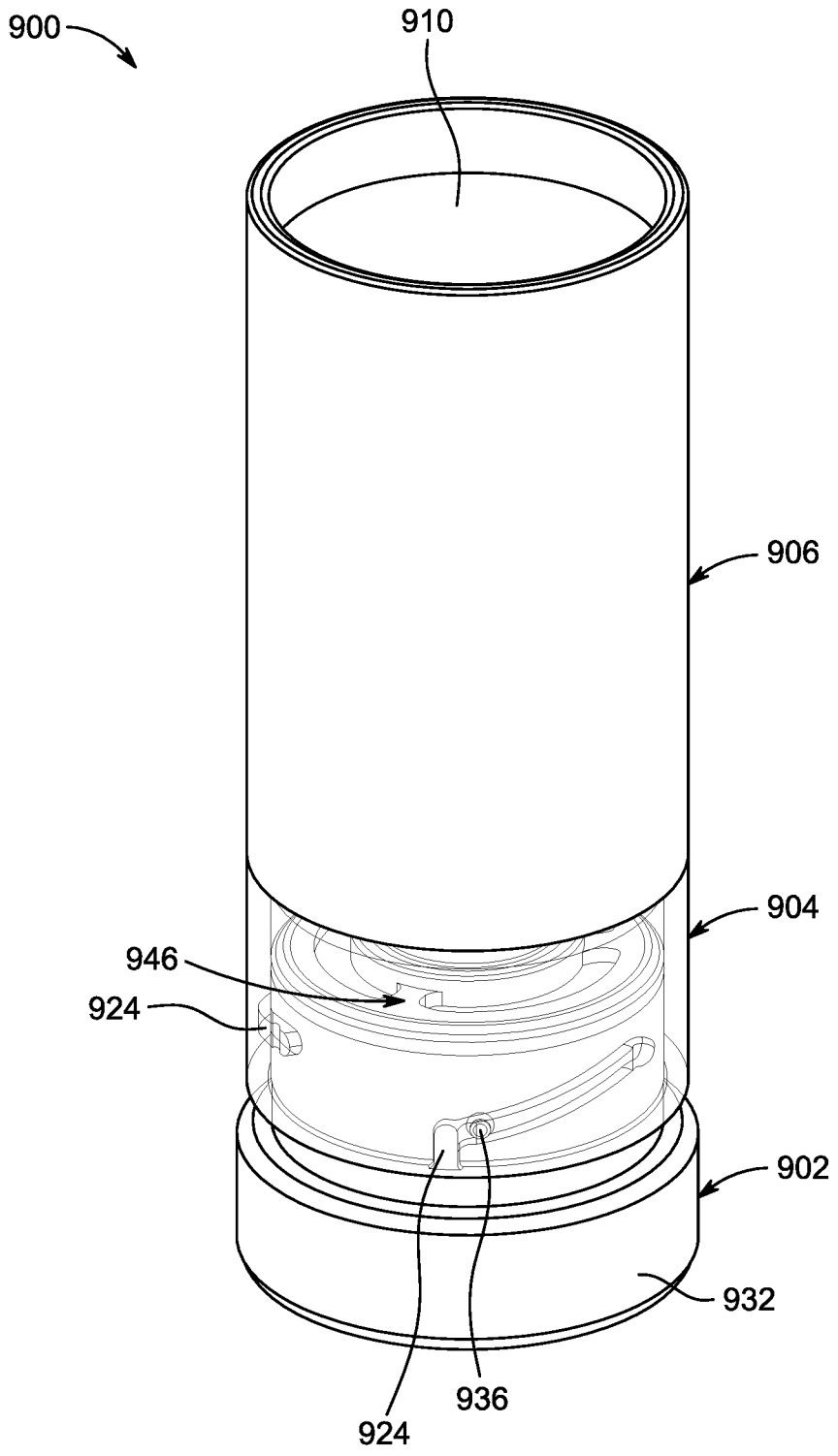

FIG. 9A shows a drinking receptacle, according to one embodiment of the present arrangements, showing certain internal features of a first fluid chamber engaging to a fluid-flow regulator and in an open configuration.

Figure 9B:
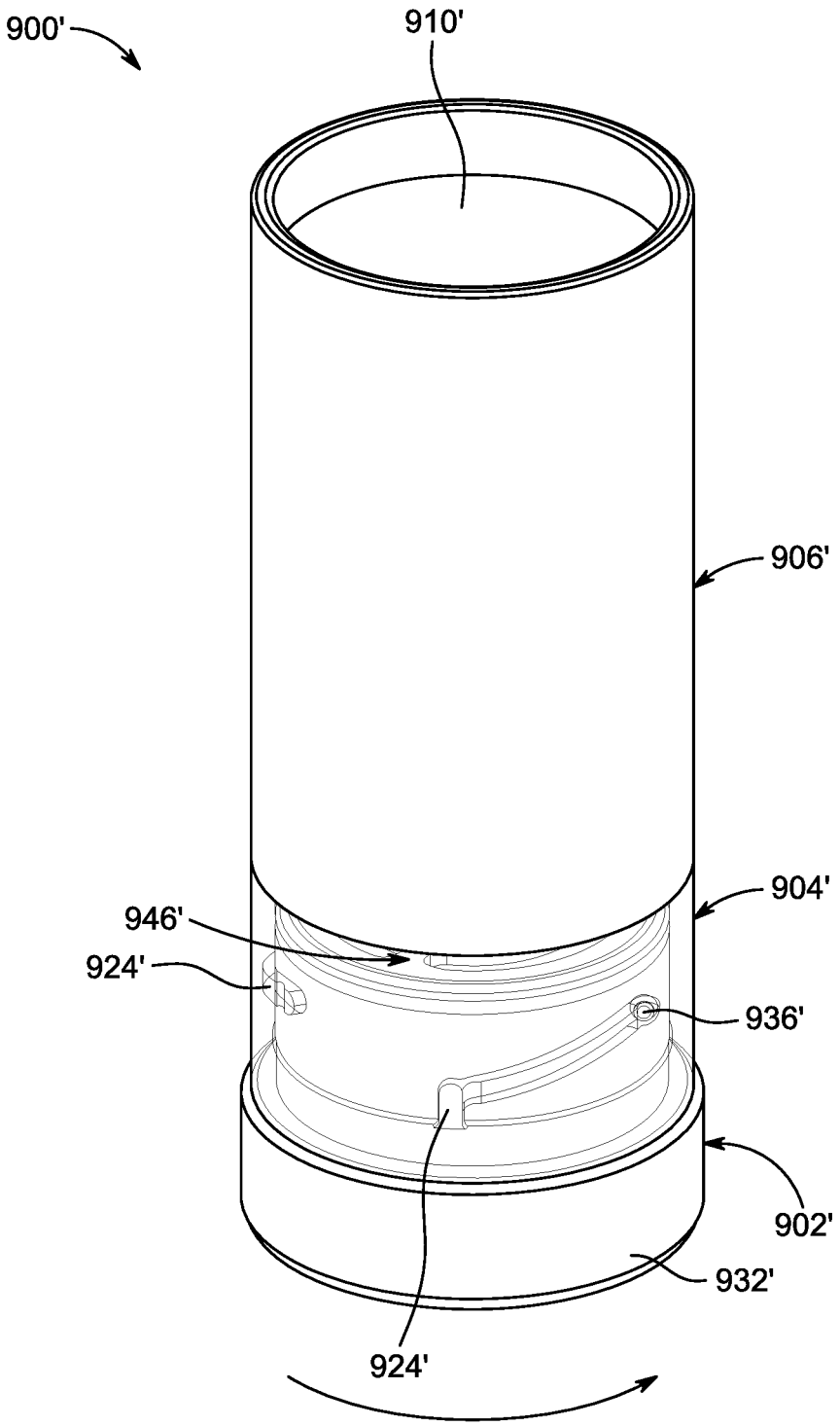

FIG. 9B shows the drinking receptacle of FIG. 9A and certain internal features of the first fluid chamber engaging to the fluid-flow regulator and in a closed configuration.

Figure 10:
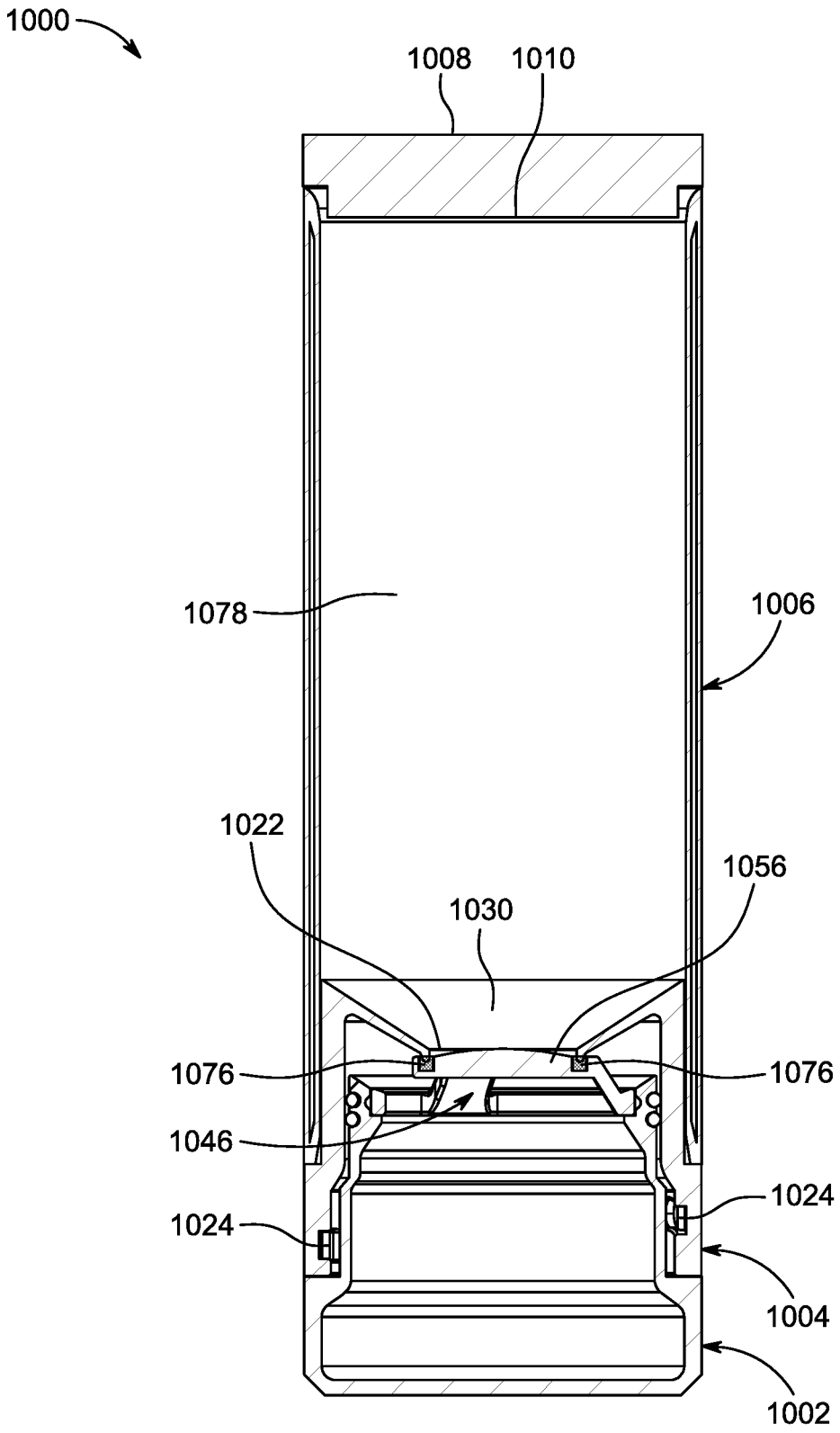
Figure 11A:
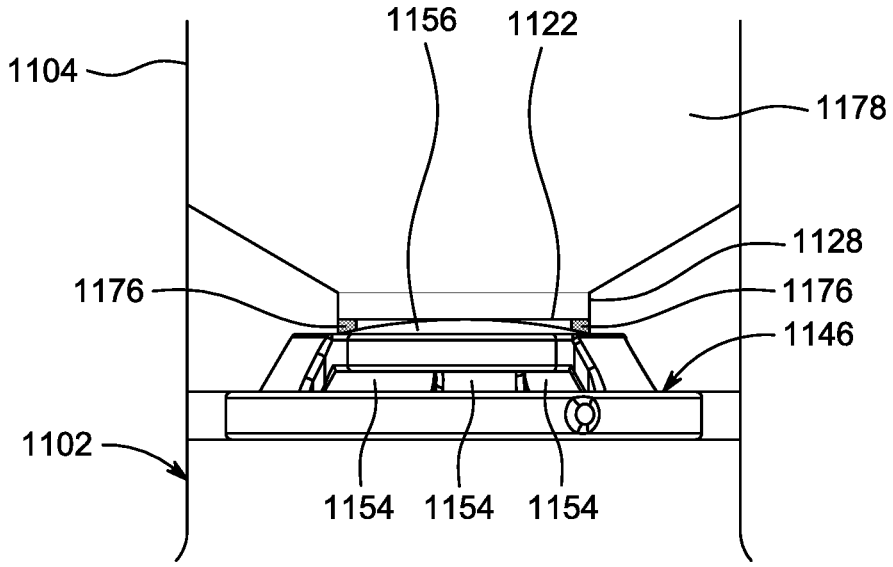

FIG. 10 is a side view of a drinking receptacle, according to one embodiment of the present arrangements, in a closed configuration and showing certain internal features thereof FIG. 11A is a side view showing certain internal features of a drinking receptacle, according to one embodiment of the present arrangements and in a closed configuration with a flow path blocked between a bottom chamber and a top chamber.

Figure 11B:
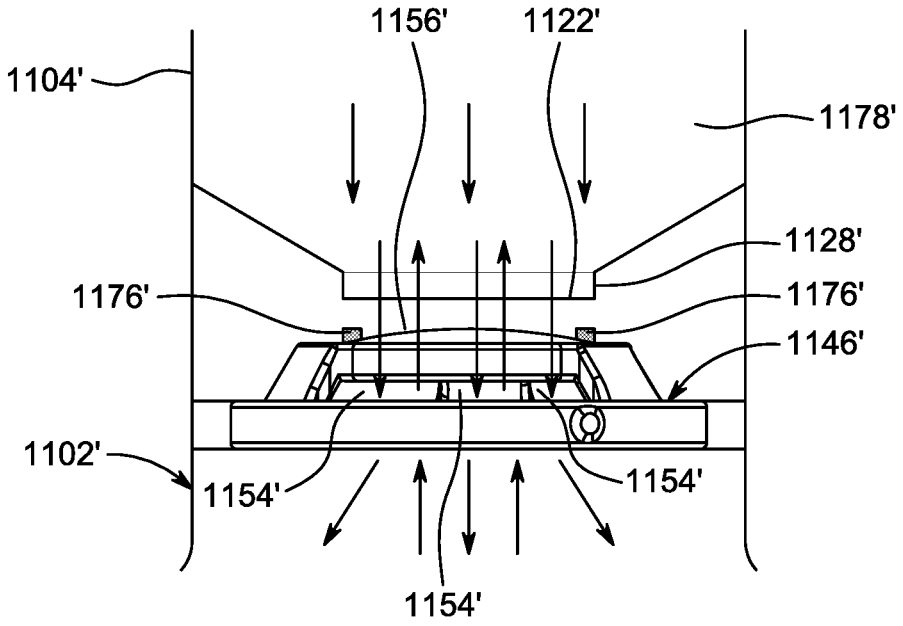

FIG. 11B is a side view of the internal features of the drinking receptacle of FIG. 11A and in an open configuration with a flow path open between a bottom chamber and a top chamber.

DETAILED DESCRIPTION OF THE PREFERRED EMBODIMENTS

In the following description, numerous specific details are set forth in order to provide a thorough understanding of the present arrangements and teachings. It will be apparent, however, to one skilled in the art that the present arrangements and teachings may be practiced without limitation to some or all of these specific details. In other instances, well-known process steps have not been described in detail in order to not unnecessarily obscure the present teachings.

The arrangements and teachings of the present inventions disclose self-cleaning drinking receptacles that provide users a means of washing such drinking receptacles (i.e., portable cups, mugs, or tumblers) after use, and immediately after use, if desired. As used herein, self-cleaning means without the need to access or otherwise carry additional equipment or materials in order to wash the portable drinking receptacle after such use. In other words, according to the present arrangements and teachings, a user may carry a washing solution (e.g., detergent and/or water) in a first, bottom chamber of a drinking receptacle, which is blocked to and from a top chamber, consume a beverage from the top chamber, and then, when cleaning is desired, open a flow path between the top and bottom chamber, and use the cleaning solution in the bottom chamber to clean the top chamber (e.g., by vigorously shaking the drinking receptacle to facilitate flow of cleaning solution from the bottom chamber to contact and wash the top chamber). This may be accomplished without disengagement the components of the drinking receptacle. Further, when the cleaning step is complete, the arrangements of the present teachings may be configured to drain used washing fluid into the bottom chamber, which then may be closed. The used washing fluid is thus captured in the bottom chamber and may be disposed when a sink, garbage receptacle, or the like, is available, and leaking of the used washing fluid may be avoided until such time.

To this end, FIG. 1 shows a perspective view of an exemplar drinking receptacle 100, according to one preferred embodiment of the present arrangements, in a closed-configuration. Drinking receptacle 100 includes a first fluid chamber 102, a fluid-flow regulator 104, and a cylindrical body 106, with a lid 108 secured at a top end of cylindrical body 106. Though not visible in FIG. 1, the drinking receptacles of the present arrangements implement a two-chamber design with a first, bottom chamber, and a second, top chamber, disposed therein (e.g., as described below with reference to first fluid chamber 1002 and second fluid chamber 1078 of FIG. 10). A "closed configuration," then, may then be thought of as of as a state of the present drinking receptacles when a flow path between the bottom chamber and the top chamber is blocked, and an "open configuration" may be thought of the state when a flow path between the bottom chamber and the top chamber is open.

Lid 108 may be secured to a top opening of cylindrical body 106 by any technique well-known to those of skill in the art, so long as securing is sufficient to prevent dislodging of, or leaking of fluid from, lid 108 during transport (e.g., in a bag with other surrounding components therein) or use (including rigorous shaking). By way of example, securing lid 108 to a body 106 may be carried out by tightly fitting, snapping, or using a thread-groove engagement.

Figure 2:
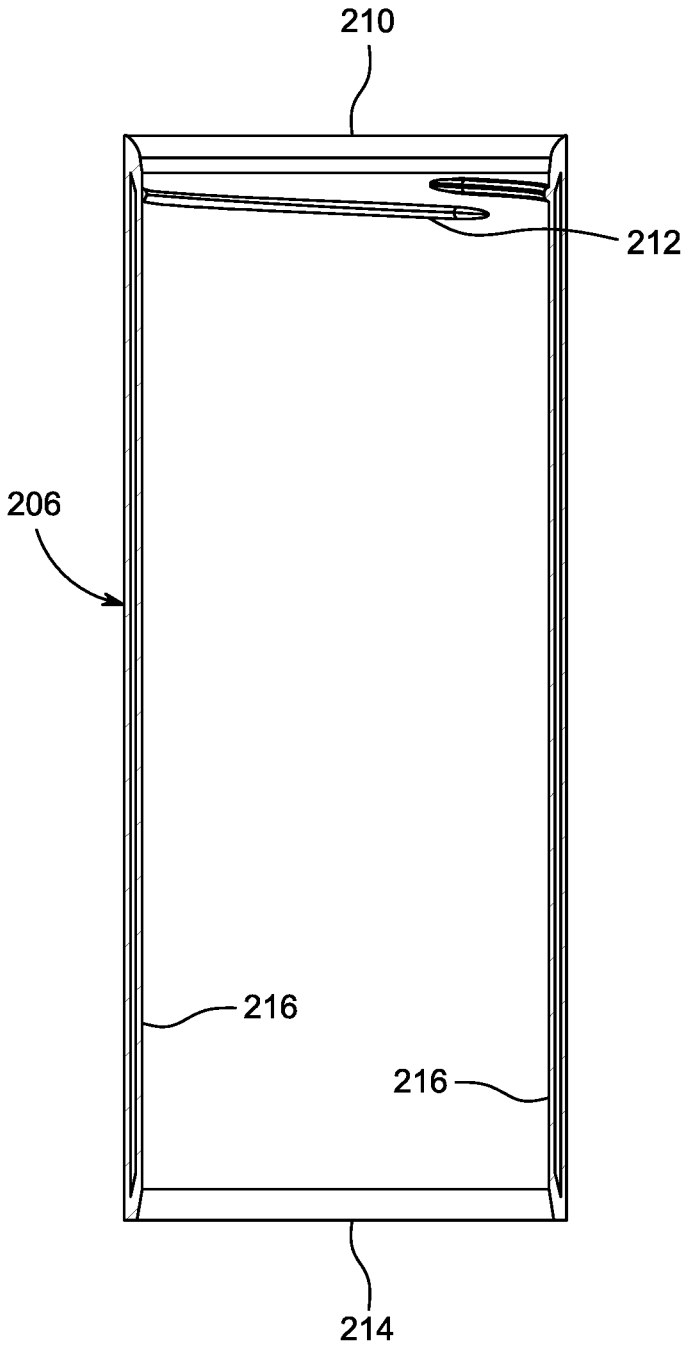
FIG. 2 is a side view showing certain internal components of a cylindrical body, or a sleeve, according to one embodiment of the present arrangements and that is used in the drinking receptacle assembly of FIG. 1.

FIG. 2 shows a side view of certain internal features of a cylindrical body 206, according to one preferred embodiment of the present invention. Cylindrical body 206 may be thought of as the same as, or substantially similar to, cylindrical body 106 of FIG. 1. Cylindrical body 206 includes a top opening 210, a bottom opening 214, grooves 212, and an inner-attaching surface 216.

Cylindrical body 206, which may also be referred to a "sleeve," may be thought of as the base or core component of the drinking receptacle assemblies of the present arrangements. Preferably, it is configured having a cylindrical shape with a circular top opening 210 and a circular bottom opening 214.

Top end 210 is the location where, when the drinking receptacles of the present arrangements are in an assembled state, fluid (e.g., a drinking beverage) will be introduced and removed (i.e., consumed) when in use. In other words, opening 210 is the mouth of the drinking receptacle when the drinking receptacles of the present arrangements are in an assembled state.

Cylindrical body 206 also includes optional grooves 212 that may be configured to align with corresponding threaded regions on a lid (e.g., lid 108 of FIG. 1) to secure the lid on the drinking receptacle. In certain embodiments of the present arrangements, grooves 212 may be disposed on an internal surface of body 206; in other embodiments of the present arrangements, grooves 212 may be disposed on an external surface of body 206.

Bottom opening 214 is the region of body 206 that receives an attaching region of a fluid-flow regulator (described in further detail below), when the drinking receptacles of the present arrangements are in an assembled state. In other words, inner surface 216 is a region within body 210 that attaches to a fluid-flow regulator.

To this end, FIG. 3A shows a side view of a fluid-flow regulator 304, according to one embodiment of the present arrangements. Fluid-flow regulator 304 is the same as, or substantially similar to, its counterpart in FIG. 1A (i.e., fluid-flow regulator 104). In FIG. 3A, fluid-flow regulator 304 has an attaching surface 318, a bottom opening 319, an engaging component 320, and a top opening 322. As explained in further detail below, the fluid-flow regulators of the present arrangements are configured to facilitate opening and closing of a flowpath between a bottom chamber and a top chamber when the drinking receptacles of the present arrangements are in use.

Attaching surface 318 is the region of fluid-flow regulator 304 that attaches to an inner surface of a cylindrical body (e.g., inner surface 216 of cylindrical body 206 FIG. 2) when the drinking receptacles of the present arrangements are in an assembled state. According to preferred embodiments of the present arrangements, attachment between attaching surface 318 and an inner surface of a cylindrical body (e.g., inner surface 216 of FIG. 2) is permanent. In other words, use of the drinking receptacles of the present arrangements does not contemplate detachment of these component parts once assembled. An attached fluid-flow regulator and cylindrical body may be thought of, together, as a "second component."

Attachment of a fluid-flow regulator to a cylindrical body to form a second component may be carried out by any technique well known to those of skill in the art, e.g., gluing, melting, nailing, tightly fitting, sticking, engaging, and the like. In other embodiments of the present arrangements, however, a second component may be configured as a single contiguous structure.

Bottom opening 319 is an opening that is configured to receive a first fluid chamber (described below with reference to FIGS. 5A and 5B) for engagement with fluid-flow regulator 304, as disclosed herein.

An outer surface of engaging component 320 is a region that forms part of the outer surface of the drinking receptacles of the present arrangements (e.g., as shown with respect to fluid-flow regulator 104 of FIG. 1). Engaging component 320 may be thought of as the component that houses internal features that are configured to engage with a first fluid chamber (e.g., first fluid chamber 102 of FIG. 1).

Opening 322 is the opening through which a flow path is defined between a top chamber and a bottom chamber. In other words, when opening 322 is blocked, the drinking receptacles of the present arrangements are in a closed configuration, and when opening 322 is not blocked, the drinking receptacles of the present arrangements are in an open configuration. Though not visible in FIG. 3A, opening 322 is disposed below a top edge of attaching surface 318.

FIG. 3B shows certain internal features, according to preferred embodiments of the present arrangements, of fluid-flow regulator 304. As shown in FIG. 3B, opening 322 is disposed beneath a top edge of attaching surface 318, with a sloping region 330 disposed therebetween. In such manner, opening 322 and/or sloping region 330 may be thought of as a barrier between a first fluid chamber and a second fluid chamber when the drinking receptacles of the present arrangements are in an assembled state. In certain embodiments of the present arrangements, this barrier is a bottom surface of a second fluid chamber.

When the drinking receptacles of the present arrangements are in use, sloping region 330 is configured to facilitate draining of fluid through opening 322 (i.e., into a bottom chamber). According to the embodiment of FIG. 3A, sloping region 330 is concave. In other embodiments of the present arrangements, however, a sloping region is not used, and the region surrounding opening 322 is relatively flat or relatively convex.

FIG. 3B also shows a connecting portion 328, which extends downward from a bottom end of opening 322. As explained in further detail below with reference to FIGS. 11A and 11B, connecting portion 328 engages with certain other components to create a seal, or barrier, that blocks or stops a flow path through connecting portion 328. In other embodiments of the present arrangements, however, a connecting portion is not implemented.

FIG. 3B also shows certain components located internal to engaging component 320, including an internal regulating sidewall 326 with channels 324 disposed therearound. In other words, regulating sidewall 326 is the inner wall of fluid-flow regulator 304, and channels 324 are disposed on this surface such that they are exposed to an inner region of fluid flow regulator 304.

As explained in further detail below, channels 324 are configured to slidably engage fluid-flow regulator 304 with a first fluid chamber (e.g., first fluid chamber 102 of FIG. 1). While FIG. 3B shows three channels 324, the systems of the present arrangements contemplate use of any number of channels. Use of three channels 324 disposed along regulating sidewall 326, however, represents a preferred embodiment of the present arrangements.

Channels 324 may be coupled to regulating sidewall 326 by any technique well-known to those of skill in the art. By way of example, channels 324 may be configured as separate components and coupled to regulating sidewall 326, or channels 324 may be etched or otherwise defined in a surface that is regulating sidewall 326 or that is coupled to regulating sidewall 326.

FIG. 3C shows a perspective view of the fluid-flow regulator of 304 of FIG. 1. Attaching surface 318, bottom opening 319, engaging component 320, opening 322, connecting portion 328, and sloping region 330, are the same as, or substantially similar to, their counterparts described above with reference to FIGS. 3A and 3B. Though the embodiment of FIG. 3C shows a relatively flat attaching surface 318, other embodiments of the present arrangement implement additional features on attaching surface 318 that facilitate attachment to an inner surface of a cylindrical body. By way of example, attaching surface 318 and an inner surface of a cylindrical body (e.g., cylindrical body 206 of FIG. 2) may be configured with complementary thread and groove features to facilitate attachment.

FIG. 4 shows a second component 400, according to one embodiment of the present arrangements and showing certain internal features of a fluid-flow regulator 404. Component 400 includes a fluid-flow regulator 404 attached to cylindrical body 406, according to one preferred embodiment of the present arrangements. Cylindrical body 406 and top opening 410 are substantially similar to their counterparts in FIG. 2 (i.e., cylindrical body 206 and top opening 210). Fluid-flow regulator 404, bottom opening 419, channels 424, and regulating sidewall 426, are substantially similar to their counterparts in FIGS. 3A and 3B (i.e., fluid-flow regulator 304, bottom opening 319, channels 324, and regulating sidewall 326).

Though not shown in FIG. 4, location of an upper opening of a fluid-flow regulator (e.g., opening 322 in FIG. 3B) defines a barrier and/or part of a barrier between a first fluid chamber and a second fluid chamber within cylindrical body 406 (as explained below with reference to opening 1022 and second fluid chamber 1078 of FIG. 10). Further, certain components shown in FIG. 4 (i.e. channels 424), are configured to engage with components of a first fluid chamber. To this end, FIG. 5A shows a side view of a first fluid chamber 502, according to one embodiment of the present arrangements. First fluid chamber 502 is substantially similar to its counterpart in FIG. 1 (i.e., first fluid chamber 102). First fluid chamber 502 may also be thought of as bottom fluid chamber, a lower fluid chamber, or a cleaning fluid chamber.

First fluid chamber 502 includes a gripping region 532 with protruding notches 534 disposed thereon, an engaging region 535 with pins 536 extending therearound, circular channel cavities 538 and 540 disposed near a top end, and an opening 542, providing access to an inner fluid chamber. First fluid chamber 502 may also be considered a "base component" that includes an inner chamber or an inner chamber region.

Gripping region 532 may be considered the portion of first fluid chamber 502 whose external surface is exposed when in the drinking receptacles of the present arrangements are in an assembled state (i.e., as shown with reference to first fluid chamber 102 in FIG. 1). Though gripping region 532 is shown to be relatively smooth in FIG. 5A, a gripping region may incorporate additional features to facilitate gripping, e.g., ridges. As explained below, a user will grip gripping region 534 to twist and/or stabilize a first fluid chamber to transform the drinking receptacles of the present arrangements from a closed configuration to an open configuration, and vice-versa.

Gripping region 534 may also optionally include one more protruding notches 534, as shown in FIG. 5B. According to certain embodiments of the present arrangements, each notch 534 aligns with each pin 536 so a user may estimate an internal location of each pin 536 when the drinking receptacles of the present arrangements are in use, as pins are internal to the drinking receptacles of the present arrangements and accordingly are not visible to a user.

As shown in FIG. 5A, pins 536 are disposed around and extend from an engaging region 535. To this end, pins 536 are configured to slidably engage with corresponding channels (e.g., channels 324 of FIG. 3B) to couple first fluid chamber 502 to a fluid-flow regulator (e.g., fluid-flow regular 304 of FIG. 3B). The systems and methods of the present arrangements contemplate use of any number of pins sufficient to slidably engage a first fluid chamber with a fluid-flow regulator, so long as such engaging provides sufficient stability to maintain the drinking receptacles of the present arrangements in a desired state (e.g., an open-configuration state or a closed-configuration state).

First fluid chamber 502 may also include one or more circular channel cavities 538 and/or 540, which are configured to receive one or more inner sealing components. In certain embodiments of the present arrangements, an inner sealing component is an o-ring. According to certain embodiments of the present arrangements, when the drinking receptacles of the present arrangements are in a closed configuration, an inner sealing component disposed in channel cavity 538 and/or 540 secures an external surface of a first-fluid chamber with and/or against a regulating sidewall of a fluid flow regulator. In such manner, one or more inner sealing components may be used to prevent leakage of fluid from the drinking receptacles of the present arrangements. Additionally, such features promote additional stability when the drinking receptacles of the present arrangements are in use.

Opening 542 is the opening where fluid is introduced or removed from first fluid chamber 502. In other words, opening 542 provides access to the inner chamber area of first fluid chamber 502.

FIG. 5B is a perspective view of first fluid chamber 502. Gripping region 532, protruding notches 534, engaging region 535, pins 536, circular channel cavities 538 and 540, and opening 542, are the same as, or substantially similar to, their counterparts in FIG. 5B. FIG. 5B also shows a hub-receiving region 544, which is configured to receive a hub, or hub assembly. Preferably, hub-receiving region is a circular indented region capable of receiving and securing therein one or more hub protrusions to couple a hub with a first fluid chamber.

To this end, FIG. 6A shows a side view of a hub 646, according to one preferred embodiment of the present arrangements. Hub 646 includes a hub base 648 with one or more hub protrusions 650 extending therearound, connecting portions 652, one or more hub apertures 654, and a blocking region 656. According to preferred embodiments of the present arrangements, a hub is configured to couple with a first fluid chamber opening (e.g., opening 542 of FIG. 5B). When coupled in such manner, the resulting component may be thought of as a "first component."

Hub base 648 includes one or more hub protrusions 650 disposed and extending therearound. According to preferred embodiments of the present arrangements, hub protrusions 650 are configured to engage with a hub-receiving region on a first fluid chamber (e.g., hub-receiving region 544 of first fluid chamber 502 of FIG. 5B). Preferably, engagement between a first fluid chamber and a hub is sufficiently secure to withstand use of the drinking receptacle of the present arrangements, while at the same time being susceptible to repeated attachment and detachment by a user (e.g., when a user uncouples a hub from a first fluid chamber to provide access to the first fluid chamber, such as for washing the inner chamber, and then couples the hub with the first fluid chamber after the washing step is complete).

One or more connectors 652 connect hub base 646 to blocking region 656. As explained below with reference to FIGS. 11A and 11B, blocking region 656 is a region that blocks a flow path through a top opening of a fluid-flow regulator (e.g., opening 322 of fluid-flow regulator 304 of FIG. 3B) when the present drinking receptacles are in a closed configuration. Preferably, in such closed configuration, blocking region 656 blocks a flow path by contacting and pushing against a connecting portion of a fluid-flow regulator (e.g., connecting portion 328 of FIG. 3B). Preferably, blocking region 656 is comprised of rubber or other compressible material that pushes against an edge of a fluid-flow regulator opening (e.g., opening 322 of FIG. 3C) or a fluid-flow regulator connecting portion (e.g., connecting portion 328 of FIG. 3C) to block a flow path between a first chamber and a second chamber when drinking receptacles of the present arrangements are in use.

To further facilitate such blocking of a flow path, blocking region 656 may also include a sealing member (e.g., an o-ring, a rubber ring, or the like) secured in sealing-member receiving region 658. To this end, FIG. 6B shows a perspective view of hub assembly 646 of FIG. 6A, showing a circular sealing-member receiving region 658 disposed around blocking region 656. Other components shown in FIG. 6B, i.e., hub base 648, hub protrusions 650, connecting portions 652, hub apertures 654, and blocking region 656, are the same as, or substantially similar to, their counterparts described with reference to FIG. 6A.

In preferred embodiments of the present arrangements, a sealing member is secured inside or at region 658 to facilitate sealing, or blocking, of a flow path through a top opening of a fluid-flow regulator (e.g., opening 322 of fluid-flow regulator 304 of FIG. 3B) when the present drinking receptacles are in a closed configuration. In other words, a sealing member in region 658 operates in conjunction with blocking portion 656 to produce this blocking function. In certain embodiments of the present arrangements, a region 658 is not used, and a sealing member is attached to or surrounds a blocking portion of a hub. In other embodiments of the present arrangements, a sealing member is not used.

Apertures 654 are the openings in hub assembly 646 where fluid enters and exits a first fluid chamber (e.g., first fluid chamber 102 of FIG. 1) when the drinking receptacles of the present arrangements are in use. In certain embodiments of the present arrangements, fluid may enter or exit a first fluid chamber through apertures 654 when the drinking receptacles of the present arrangements are in an open or in a closed configuration. In other words, according to such embodiments, even where a flow path is blocked into and out of a second fluid chamber (e.g., by blocking region 656 of hub 646), such blocking does not prevent fluid flow out of a first fluid chamber through hub apertures (e.g., hub apertures 654 of hub 646). Accordingly, certain features described above, such as regions 538 and 540 on first fluid-chamber 502 of FIG. 5A, may be used to confine fluid that exits hub apertures 654 within the drinking receptacles of the present arrangements when in use. In other embodiments of the present arrangements, however, features or that block apertures 654 are implemented such that fluid flow is blocked through hub apertures 654 when the drinking receptacles of the present invention are in use. According to one such embodiment, a hub is configured such that hub apertures 654 contact and are sealed by a bottom surface of, or a surface beneath, a sloping region of a fluid-flow regulator (e.g., fluid-flow regulator 304 of FIGS. 3A-3C) when the drinking receptacles of the present arrangements are in a closed-configuration state.

FIG. 7 shows a perspective view of a first component 700, according to one embodiment of the present arrangements. Component 700 includes a hub 746 coupled to a first fluid chamber 702. FIG. 7 also shows a gripping region 732, a notch 734, an engaging region 735, and a pin 736, which are substantially similar to their counterparts in FIGS. 5A and 5B (i.e., first fluid chamber 502, gripping region 534, notches 534, engaging region 534, and pins 536). FIG. 7 also shows a hub 746 with a hub base 748, connectors 752, hub apertures 754, blocking region 756, and sealing-member receiving region 758, which are substantially similar to their counterparts in FIGS. 6A and 6B (i.e., hub 646 with a hub base 648, connectors 652, hub apertures 654, blocking region 656, and sealing-member receiving region 658). Though the components shown are substantially similar to the identified counterparts, they are not intended to be shown as exactly the same. For example, in the embodiment of FIG. 7, hub 746 has a relatively flatter configuration than its counterpart in FIGS. 6A and 6B, hub 646. Nevertheless, the component parts are analogous.

FIG. 7 shows a "first component," as defined herein, and FIG. 4 shows a "second component," as defined herein. According to preferred embodiments of the present arrangements, a first component engages with a second component to form the drinking receptacles of the present arrangements. Disengaging of a first component and a second component, however, is also contemplated by the teachings of the present inventions. For example, a first component and a second component may be disengaged to wash component parts and/or to introduce fluid (e.g., cleaning fluid) into a first fluid chamber prior to engaging a first component and a second component. This may be considered a "disengaged configuration" of the drinking receptacles of the present inventions.

FIGS. 8A-8C show the state of certain salient components associated with placing or securing the drinking receptacles of the present arrangements in the various configurations disclosed herein. To this end, FIG. 8A shows a pin 836 and a channel 824 in a disengaged configuration. As used herein, reference to a pin and channel being in a particular configuration is coextensive with the drinking receptacles of the present arrangements being in that configuration.

According to the embodiments of FIG. 8A, pin 836 is substantially similar to its counterpart in FIGS. 5A and 5B (i.e., pin 536), and channel 824 is substantially similar to its counterpart in FIG. 3B (i.e., channel 324).

FIGS. 8A-8C (as well as FIG. 3B) show a back view of pins engaged to channels in various configuration described herein. In other words, the channel side shown in FIGS. 8A-8C may be thought of as the side that engages with a regulating sidewall (e.g., regulating sidewall 326 of FIG. 3B). Preferably, a surrounding perimeter of channel 824 is comprised of raised edges of sufficient depth and rigidity to secure pin 836 within the confines of the channel when the drinking receptacles of the present arrangements are in use.

In FIG. 8A, channel 836 includes a channel opening 860, a first bridge 862, an open configuration location 864, a second bridge 866, a third bridge 868, a closed-configuration location 870, a location of ceasing forward displacement 872, and partially open configuration region 874. Each of bridges 862, 866, and 868, is a raised portion or feature that traverses channel 832 between its edges. In such manner, bridges and edges associated with channel 836 define certain locations along channel 836 where a pin may be stabilized.

As shown in FIG. 8A, pin 836 is disposed adjacent to channel opening 860 of channel 824. Preferably, channel opening 860 does not have a raised edge such that introduction of pin 836 into channel 824 is facilitated by a simple upward pushing motion of a first fluid channel on which pin 836 is disposed. Channel opening 860 may also be thought of as a "location of entrance" for pin 836 into channel 824.

FIG. 8B shows a pin 836' disposed at an open configuration location 864', according to one embodiment of the present arrangements. In other words, FIG. 8B shows the location of pin 836' when a drinking receptacle of the present arrangements is in an open configuration. A channel 836', a channel opening 860', a first bridge 862', an open configuration location 864', a second bridge 866', a third bridge 868', a closed-configuration location 870', and a location of ceasing forward displacement 872', are substantially similar to their counterparts in FIG. 8A. Pin 836' is stabilized at open-configuration location 864' insofar as it is secured between bridge 862', bridge 866', and raised channel edges that connect bridge 862' to bridge 866'. Open-configuration location 836' may also be thought of as a location of rinsing, and bridges 862' and 866' may be thought of as rinse bridges, or rinse features. In other words, pin 836' may be disposed at location 836' when a rinsing step is implemented, as described below with reference to a method of using drinking receptacles of the present arrangements and teachings.

FIG. 8C shows a pin 836" disposed at a closed configuration location 864", according to one embodiment of the present arrangements. In other words, FIG. 8C shows the location of pin 836" when a drinking receptacle of the present arrangements is in a closed configuration. A channel 824", a channel opening 860", a first bridge 862", an open configuration location 864", a second bridge 866", a third bridge 868", closed-configuration location 870", and a location of ceasing forward displacement 872", are substantially similar to their counterparts in FIG. 8A. As shown in FIG. 8C, pin 836' is stabilized at closed-configuration location 870' insofar as it is secured between bridge 868" and location of ceasing forward displacement 872", which may be thought of as the edge of channel 824" extending from bridge 868" to the end of channel 824".

The novel channel-design configurations disclosed herein, and incorporation of a location of entry and bridge features with an open-configuration location and a closed-configuration location, provide a mechanism whereby drinking receptacles of the present arrangements may be locked in place in open or closed configurations, while at the same time providing the user a means for transforming drinking receptacles between open and closed configurations without disassembly of various components (e.g., a first component and a second component).

FIGS. 8A, 8B, and 8C also show partially open configuration regions (i.e., regions 874, 874', and 874", respectively), which may be thought of as regions where, when a pin is located therein, the drinking receptacles of the present arrangements are in a partially open configuration. Preferably, the channels of the present drinking receptacles are not configured to secure a pin in a partially open configuration and a pin traverses a partially open configuration region when the drinking receptacles of the present arrangements are transforming between open and closed configurations. In certain embodiments of the present arrangements, however, one or more partially open configuration locations may be established by incorporation, for example, of one or more additional bridge features to a channel along a partially open configuration region.

FIG. 9A shows a drinking receptacle 900, according to one embodiment of the present arrangements, in an open configuration. Drinking receptacle 900 includes a first fluid chamber 902, a gripping region 932, a pin 936, and a hub 946, which are substantially similar to their counterparts in FIG. 7, i.e., first fluid chamber 702, gripping region 732, pin 736, and hub 746. FIG. 9A also shows a fluid-flow regulator 904, a cylindrical body 906, and a channel 924, which are substantially similar to their counterparts in FIG. 4 (i.e., fluid-flow regulator 404, cylindrical body 406, and channel 424). FIG. 9A may be thought of as showing engagement of a first component and a second component such that pin 936 is secured at an open configuration location on channel 924. Further, in this open configuration shown in FIG. 9A, a distance is established between a bottom edge of fluid-flow regulator 904 and a top edge of gripping region 732.

FIG. 9B shows a drinking receptacle 900', according to one embodiment of the present arrangements, in a closed configuration. Drinking receptacle 900' includes a first fluid chamber 902', a fluid-flow regulator 904', a cylindrical body 906', a channel 924', a gripping region 932', a hub 946', and a pin 936', which are the same as, or substantially similar to, their counterparts in FIG. 9A. The arrow beneath drinking receptacle 900' shows a direction of rotation of a first component (i.e., first chamber 902' coupled to hub assembly 946') relative to a second component (i.e., fluid-flow regulator 904' attached to cylindrical body 906') to transform the open configuration of FIG. 9A to the closed configuration of FIG. 9B. Such rotation is facilitated by a user rotating a first component relative to a second component in the direction of the arrow (e.g., including by gripping at gripping region 932' of a first-fluid chamber). According to the embodiment of FIG. 9B, where drinking receptacle 900' is in a closed configuration, a bottom edge of fluid-flow regulator 904' contacts or abuts gripping region 932'.

Preferably, drinking receptacles of the present arrangements are configured such that securing of pins at open-configuration locations and closed-configuration locations is maintained during expected use, as describe herein, but flexible enough such that transformation between open and closed configurations may be carried out without undue effort by a user.

FIG. 10 shows a side view of certain internal details of a drinking receptacle 1000, according to one embodiment of the present arrangement, in a closed configuration. Drinking receptacle 1000 includes a first fluid chamber 1002, a fluid-flow regulator 1004, a body 1006, and a lid 1008, which are substantially similar to their counterparts in FIG. 1 (i.e., first fluid-chamber 102, fluid-flow regulator 104, body 106, and lid 108). FIG. 10 further shows an opening 1022, channels 1024, and a sloping region 1030, which are substantially similar to their counterparts in FIG. 3B, i.e., opening 322, channel 324, and sloping region 330. FIG. 10 further shows a hub 1046 with a blocking region 1056, which are substantially similar to their counterparts in FIGS. 6A and 6B, i.e., hub 646 and blocking region 656. FIG. 10 further shows a sealing member 1076, which may be thought of as a ring that is secured inside a sealing-member receiving region on hub 1046 (e.g., sealing-member receiving region 658 of FIG. 6B). Though sealing member 1076 is circular and surrounds blocking region 1056, it is shown as a cross-section in FIG. 10 so as not to obscure view of blocking region 1056.

As shown in FIG. 10, in a closed configuration of drinking receptacle 1000, sealing member 1076 and blocking region 1056 contact to create a seal between first fluid chamber 1002 and a second fluid chamber 1078 (i.e., at opening 1022). Second fluid chamber 1078 may also be considered a top fluid chamber or an upper fluid chamber. Further, as shown in FIG. 10, second fluid chamber 1078 is defined by sloping region 1030, the region of cylindrical body 1006 that extends upward from sloping region 1030, and the seal at opening 1022.

FIG. 11A shows certain internal components of a drinking receptacle of the present arrangements in an operative state, where a flow path is blocked between a first fluid chamber 1102 and a second fluid chamber 1178, according to one preferred embodiment of the present arrangements. FIG. 11A includes first fluid chamber 1102, a fluid-flow regulator 1104, an opening 1122, a hub 1146, hub apertures 1154, a blocking region 1156, a sealing member 1176, and second fluid chamber 1178, which are substantially similar to their counterparts in FIG. 10, i.e., first fluid chamber 1002, fluid-flow regulator 1004, opening 1022, blocking region 1056, hub 1046, hub apertures 1054, sealing member 1076, and second fluid chamber 1178. Also shown in FIG. 11A is a connecting portion 1128, which is substantially similar to its counterpart in FIG. 3C (i.e., connecting portion 328). As shown in FIG. 11A, blocking portion 1156 and sealing member 1176 are shown blocking opening 1022 of fluid-flow regulator 1004 (i.e., by blocking at connection portion 1128). In such manner, a flow path between first fluid chamber 1102 and second fluid chamber 1178 is blocked. In such manner, the drinking receptacles of the present arrangements are in a closed configuration (e.g., as shown in in FIG. 9B).

FIG. 11B shows certain internal components of a drinking receptacle of the present arrangements in an operative state where a flow path is open between a first fluid chamber 1102' and second fluid chamber 1178'. First fluid chamber 1102', a fluid-flow regulator 1104', an opening 1122', a connecting portion 1128', a hub 1146', hub apertures 1154', a blocking region 1156", a sealing component 1176', and second fluid chamber 1178, are substantially similar to their counterparts in FIG. 11A. Unlike in FIG. 11A, however, FIG. 11B shows opening 1022' not blocked or sealed. In such manner, a flow path between first fluid chamber 1102' and second fluid chamber 1178', as shown by the arrows on FIG. 11B, is open. Further, as shown in FIG. 11B, hub apertures 1154' provide access into and out of first fluid chamber 1102'. Thus, according to the embodiment of FIG. 11B, an open configuration is established.

The various components described herein may be comprised of any suitable materials well-known to those of skill in the art, including combinations thereof. According to one preferred embodiment of the present arrangements, the components of the drinking receptacles of the present arrangements are comprised of at least one member selected from a group comprising a metal, a stainless steel, a plastic, a rubber, a synthetic material, and a composite. The present teachings recognize that certain materials may provide advantages or disadvantages in carrying out intended use of the receptacles of the present arrangements. For example, materials that promote temperature preservation of beverages are preferably used. Further, materials that leach in the presence of certain fluids (e.g., relatively hot beverages, or acidic beverages such as fruit juice), are preferably avoided to the extent use of the drinking receptacles of the present arrangements would cause prolonged contact of a beverage with such material. Further, insulating material may be incorporated as part of the components described herein, or surrounding components described herein, to promote temperature preservation.

Further still, in certain preferred embodiments of the present arrangements, a buna rubber is used to construct the sealing members or o-rings described herein. In particular, buna provides the advantage of being oil-resistant. Further, sealing members or o-rings may be configured in various profiles. In certain embodiments of the present arrangements, a sealing member has a flat profile. In other embodiments of the present arrangements, a sealing member has a round profile.

In another aspect, the systems and teachings of the present arrangements disclose certain salient steps of methods of using the drinking receptacles of the present arrangements and teachings. According to one embodiment of the present teachings, the method begins with a first step of obtaining a drinking receptacle in a closed configuration (e.g., drinking receptacle 100 of FIG. 1).

Next, the method may include disengaging a first component (i.e., a first fluid chamber with a hub assembly coupled thereon, as shown in FIG. 7) from a second component (i.e., a fluid-flow regulator attached to a body, as shown in in FIG. 4). Disengaging in this step may be carried about by a user gripping a gripping portion (e.g., gripping portion 732 of FIG. 7) and rotating the first component relative to the second component such that one or more pins (e.g., pin 736 of FIG. 7) is disengaged from one or more channels (e.g., channel 424 of FIG. 4). By way of example, disengaging may include rotating and otherwise adjusting the location of the first component such that a pin exits a channel opening (e.g., channel opening 860 in FIG. 8A). Such disengagement may be facilitated by a user pulling a first component downward relative to a second component.

Next, the method may include removing, or uncoupling, a hub assembly (e.g., hub 746 in FIG. 7) from a first fluid chamber (e.g., first fluid chamber 702 of FIG. 7).

Next, the method may include introducing a cleaning material and/or water into a first fluid chamber. A cleaning material may be any material sufficient to clean a cup after a beverage has been consumed therefrom. By way of example, a cleaning material may be a soap, a detergent, an alcohol, baking soda, a vinegar, a synthetic cleaning solution, or the like. In certain embodiments of the present arrangements, however, a hub is not removed before introducing a washing fluid, and introducing a washing fluid is carried out through one or more hub apertures. In certain embodiments of the present arrangements, water is also added.

Next, the method may include engaging, or coupling, the hub assembly onto the first fluid chamber to form the first component, with washing fluid and/or water disposed therein.

Next, the method may include engaging the first component with the second component such that the resulting drinking receptacle is in a closed configuration. In this respect, engaging means securing one or more pins in closed-configuration locations located on channels (e.g., closed configuration locations 870" in channels 824" in FIG. 8C). In such manner, a second fluid chamber (e.g., second fluid chamber 1078 in FIG. 10) is defined, and a flow path between a first fluid chamber and a second fluid chamber is blocked.

Next, the method may include filling the second fluid chamber with a beverage, e.g., water, soda, an alcoholic beverage, tea, coffee, juice, or soft drink.

Next, the method may include drinking the beverage from the second fluid chamber (e.g., through top opening 1010 of FIG. 10).

Next, the method may include securing a lid (e.g., lid 108 of FIG. 1) onto a top opening of the drinking receptacle body.

Next, the method may include transforming the drinking receptacle from a closed configuration to an open configuration, i.e., displacing a pin from a closed-configuration location on a channel to an open-configuration location on a channel (e.g., as shown in FIG. 8B with pin 836' being secured at open-configuration location 864' on channel 824'). Displacing may be carried out by gripping and twisting a gripping region of a first fluid chamber. In such manner, a flow path between a first fluid chamber and a second fluid chamber is opened (i.e., as explained above with reference to FIGS. 11A and 11B).

Next, the method may include vigorously shaking the fluid receptacle such that cleaning fluid contacts and washes surfaces associated with the second fluid chamber (e.g., second fluid chamber 1078 of FIG. 10), to produce used washing fluid. In such manner, the closed-configuration location in the previous step may be considered a rinsing location.

Prior to this step, water or other fluid or cleaning material may also be added. During the rinsing step, washing fluid from the first fluid chamber will pass through one or more hub apertures (e.g., hub apertures 754 of FIG. 7) and through an opening of a fluid-flow regulator (e.g., opening 322 of FIG. 3C) to contact and washes surfaces of a second fluid chamber.

Next, the method may include draining the used washing fluid into the first fluid chamber. Draining may be facilitated by use of a fluid-flow regulator that implements a sloping region (i.e., a region that concaves, e.g., sloping region 330 of FIG. 3C) such that force of gravity will facilitate draining.

Next, the method may include transforming the drinking receptacle from an open configuration to a closed configuration, as described above. In such manner, the used washing fluid may be contained in the closed first fluid chamber until it may be emptied into a drain, a garbage receptacle, or the like.

Next, the second fluid chamber (i.e., the top fluid chamber) may either be re-used by adding another beverage, or it will be much easier to clean in downstream cleaning steps, as filth and residue that would otherwise have accumulated, or would otherwise have been stuck to the surface of the second fluid chamber, absent the above washing steps, have been dislodged, cleaned, or otherwise removed. If the second chamber is re-used before additional washing at a later time, it may be rinsed with water or a cleaning alcohol prior to such re-use.

In another aspect, the present teachings disclose certain salient steps of a method, according to one preferred embodiment of the present arrangements, of assembling a fluid receptacle. The method of assembly may begin with obtaining a base component and a hub (e.g., hub 646 of FIGS. 4A and 4B), wherein the base component includes a first fluid chamber that is designed to hold a first fluid, and one or more pins disposed around an external surface of the first fluid chamber, and the hub includes a blocking portion and one or more hub apertures. In certain embodiments of the present teachings, a base component is a first fluid chamber (e.g., first fluid chamber 502 of FIGS. 5A and 5B).

Next, the method of assembly may include coupling the base component with the hub to form a first component. Coupling may include engaging hub protrusions (e.g., hub protrusions 650 of FIGS. 6A and 6B) with a hub-receiving region (e.g., hub-receiving region 544 of FIG. 5B) to secure the hub.

Next, the method of assembly may include obtaining a cylindrical component having a first open end and a second open end, wherein the second open end includes an inner surface. In preferred embodiments of the present arrangements, the cylindrical component is a body (e.g., body 206 of FIG. 2).

Next, the method of assembly may include obtaining a fluid-flow regulator (e.g., fluid-flow regulator 322 of FIGS. 3A-3C) that includes a regulating sidewall (e.g., regulating sidewall 326 of FIG. 3B) and a barrier (which may also include an opening, e.g., opening 322 of FIG. 3B), wherein the regulating sidewall has defined thereon one or more channels (e.g., channels 324 of FIG. 3B), each of which contains an open-configuration end and a closed-configuration end (as described above with reference to FIGS.

8A-8C), and wherein the barrier has a fluid flow opening and/or includes a fluid opening (e.g., opening 322 of FIG. 3B).

Next, the method of assembly includes inserting the fluid-flow regulator into, and securing it inside, the second open end of the cylindrical component to form a second component, such that an outer surface of the regulating sidewall of the fluid-flow regulator aligns with and contacts an inner surface of the cylindrical component (e.g., inner surface 216 of FIG. 2).

Next, the method may include engaging the first component and the second component to form a drinking receptacle, such that pins disposed around the first fluid chamber are in position to slidably engage within each of the channels of the fluid flow regulator.

The novel systems and methods of the present arrangements and teachings provide certain advantages over conventional designs. As one example, a user may avoid carrying around a dirty cup when away from home or anywhere else the receptacle may be washed, thus avoiding the accumulation and drying of dirty residue that may be smelly and/or difficult to clean at a later time. Leaking of leftover beverages may be avoided by implementing the present teachings and arrangements.

Further, the novel two-chamber design provides a means to carry a washing fluid in a bottom chamber, which remains closed from a top chamber until a cleaning step is initiated, thus avoiding the need to wait to wash the drinking receptacles of the present arrangements until a washing fluid is available, or to carry washing fluid in a separate container, thus providing additional convenience to the user.

Further still, the two-chamber design of the drinking receptacles of the present arrangements and teachings may be used for other purposes, such as storing separate components in a top chamber and a bottom chamber that may be mixed later. By way of example, a user may place powdered milk in a bottom chamber and water in a top chamber while the drinking receptacle is in a closed configuration, and then later, when ready to drink milk, transform the drinking receptacle to an open-configuration state, defining a flow path between the top chamber and bottom chamber. The resulting flow path may then be used to mix water and dried milk, e.g., through a vigorous shaking motion.

Further still, the systems and methods of the present teachings and arrangements contemplate use of more than two chambers in drinking receptacles of the present teachings and arrangements. By way of example, multiple fluid chambers, analogous to first fluid chambers (i.e., base components) described herein may be arranged, in sequence vertically, to house separate components in each chamber that may later be mixed when flow paths are opened between such fluid chambers. Such fluid chambers may also be integrated with features that define a top fluid chamber, as described herein.

Although illustrative embodiments of the present arrangements and teachings have been shown and described, other modifications, changes, and substitutions are intended. Accordingly, it is appropriate that the appended claims be construed broadly and in a manner consistent with the scope of the disclosure, as set forth in the following claims.

The invention claimed is:

1. A drinking receptacle comprising:

a first component including:

a first fluid chamber to hold first fluid and having defined therein, at one end, one or more fluid apertures that allow flow of first fluid in and/or out of said first fluid chamber;

one or more pins disposed around an external surface of said first fluid chamber;

a second component including:

a second fluid chamber for holding second fluid, said second fluid chamber having defined therein a first opening disposed at one end of said second fluid chamber, and having defined therein a second opening disposed at an opposite end of said second fluid chamber, wherein said first opening allows receiving and/or dispensing fluid content inside said second fluid chamber and said second opening of said second fluid chamber allows receiving first fluid inside said second fluid chamber;

a fluid-flow regulator designed to allow or restrict flow of first fluid into said second fluid chamber and comprising a regulating sidewall and a barrier, wherein said regulating sidewall has defined thereon one or more channels, each of which contains an open-configuration end and a closed-configuration end, and wherein said barrier has defined thereon said second opening that defines a flow path between said first fluid chamber and said second fluid chamber;

wherein each of said pins disposed around said first fluid chamber slidably engages with each of said channels of said fluid flow regulator such that each of said pins is disposed at said closed-configuration end of said each channel to form a closed configuration of said second opening, in which flow through said flow path is closed; and wherein each of said pins is disposed at said open-configuration end of said each channels to form an open configuration of said second opening, in which flow through said flow path is open.

2. The drinking receptacle of claim 1, further comprising a hub that is connected to said first component and includes a blocking portion and one or more hub apertures, and wherein in said closed configuration of said second opening, said one or more hub apertures are not communicatively coupled to said second opening and said blocking portion aligns and contacts with said second opening to close said flow path.

3. The drinking receptacle of claim 2, further comprising a sealing member that is part of said blocking portion and operates to seal off said second opening in said closed configuration of said second opening.

4. The drinking receptacle of claim 1, wherein said open configuration of said second opening, said one or more hub apertures, and said second opening, define said flow path and said blocking portion does not completely block fluid flow through said second opening.

5. The drinking receptacle of claim 1, further comprising a lid that seals fluid flow out of said first opening of said second fluid chamber.

6. The drinking receptacle of claim 1, further comprising a gripping portion disposed at or near a bottom end of said first fluid chamber.

7. The drinking receptacle of claim 1, wherein said components of said drinking receptacle are made from of at least one material chosen from a group comprising plastic, glass, graphite, composite, stainless steel, ceramic, stone, porcelain, paper, bamboo, and polystyrene.

8. The drinking receptacle of claim 1, wherein said barrier concaves to drain out, under force of gravity, fluid through said second opening of said second fluid chamber.

9. The drinking receptacle of claim 1, wherein each of said pins is slidably disengaged from each of said channels, to form a detached configuration of said second opening.

10. The drinking receptacle of claim 1, wherein each of said channels, at said open configuration end, includes a location of entrance, and at said closed-configuration end, includes a location of ceasing forward displacement, wherein said pins initially engage with each of said channels at said location of entrance and said pins cease forward displacement along each of said channels at said location of forward displacement.

11. The drinking receptacle of claim 10, wherein said location of ceasing forward displacement includes a boundary of said channel and a bridge feature, and in said closed-configuration, said pins are stabilized between said boundary and said bridge feature.

12. The drinking receptacle of claim 10, wherein said open-configuration end includes a location of rinsing, adjacent to said location of entrance, wherein said location of rinsing is defined by two rinse-bridge features disposed adjacent to each other and of appropriate dimensions such that each of said pins, during a rinsing operation of said drinking receptacle, is stabilized between said two rinse-bridge features.

13. The drinking receptacle of claim 12, further comprising a plurality of partially open-configuration positions disposed between said location of rinsing and said location of ceasing forward displacement.

14. The drinking receptacle of claim 1, further comprising an inner sealing component disposed around said external surface of said first fluid chamber, said external surface having defined therein a circular channel cavity that receives said inner sealing component, and in said closed configuration of said second opening, presence of said inner sealing component secures together said external surface of said first fluid chamber and said regulating sidewall of said fluid flow regulator.

15. The drinking receptacle of claim 1, further comprising a hub that is connected to said first component, said hub having one or more hub apertures, and wherein in said closed configuration of said second opening, said one or more hub apertures are blocked such that said one or more hub apertures are not communicatively coupled to said second opening.

16. The hub of claim 2, further comprising one or more protruding portions disposed along an outer edge of said hub such that said protruding portions are designed to engage with said first fluid chamber to form said first component.

17. The hub of claim 2, further comprising a sealing component surrounding said blocking portion.

18. The drinking receptacle of claim 1, wherein said first component and said second component are separated to provide access to said first fluid chamber for introducing cleaning fluid in said first fluid chamber.

19. A method of assembling a drinking receptacle, said method comprising:

obtaining a base component and a hub, wherein said base component includes a first fluid chamber that is designed to hold a first fluid, and one or more pins disposed around an external surface of said first fluid chamber, and said hub includes a blocking portion and one or more hub apertures;

coupling said base component with said hub to form a first component;

obtaining a cylindrical component having a first open end and a second open end, wherein said second open end includes an inner surface;

obtaining a fluid-flow regulator including a regulating sidewall and a barrier, wherein said regulating sidewall has defined thereon one or more channels, each of which contains an open-configuration end and a closed-configuration end, and wherein said barrier has a fluid flow opening;

inserting said fluid-flow regulator into and securing inside said second open end of said cylindrical component to form a second component, such that an outer surface of said regulating sidewall of said fluid-flow regulator aligns with and contacts said inner surface of said cylindrical component; and engaging said first component and said second component to form said drinking receptacle, in which said pins disposed around said first fluid chamber are in position to slidably engage with each of said channels of said fluid flow regulator.

20. The method of claim 19, wherein said first fluid chamber has defined therein an opening, and said coupling includes fitting said hub inside said opening of said first fluid chamber.

* * * * *